US009905234B2

(12) United States Patent
Baeck et al.

(10) Patent No.: US 9,905,234 B2
(45) Date of Patent: Feb. 27, 2018

(54) APPARATUS AND METHOD FOR HIDING AND EXTRACTING DATA USING PILOT CODE SEQUENCE

(71) Applicant: Electronics and Telecommunications Research Institute, Daejeon (KR)

(72) Inventors: Seung Kwon Baeck, Seoul (KR); Tae Jin Park, Daejeon (KR); Jong Mo Sung, Daejeon (KR); Yong Ju Lee, Daejeon (KR); Tae Jin Lee, Daejeon (KR); Jin Soo Choi, Daejeon (KR)

(73) Assignee: Electronics and Telecommunications Resarch Institute, Daejeon (KR)

( * ) Notice: Subject to any disclaimer, the term of this patent is extended or adjusted under 35 U.S.C. 154(b) by 0 days.

(21) Appl. No.: 15/051,232

(22) Filed: Feb. 23, 2016

(65) Prior Publication Data

US 2016/0293171 A1 Oct. 6, 2016

(30) Foreign Application Priority Data

Apr. 2, 2015 (KR) ..... 10-2015-0046817

(51) Int. Cl.
*G10L 19/018* (2013.01)

(52) U.S. Cl.
CPC ..... *G10L 19/018* (2013.01)

(58) Field of Classification Search
CPC ..... G10L 19/018; H04N 21/8358
See application file for complete search history.

(56) References Cited

U.S. PATENT DOCUMENTS 6,314,192 B1 * 11/2001 Chen ..... G06T 1/0028 382/100
6,442,283 B1 * 8/2002 Tewfik ..... G06T 1/0028 380/210
7,653,211 B2 * 1/2010 Kogure ..... G06T 1/0064 382/100
8,908,905 B2 12/2014 Hwang et al.
2002/0078359 A1 6/2002 Seok et al.
2005/0033579 A1 * 2/2005 Bocko ..... G10L 19/018 704/273
2009/0103460 A1 * 4/2009 Oh ..... H04J 13/0003 370/280
2009/0125310 A1 5/2009 Lee et al.
(Continued)

OTHER PUBLICATIONS

Lin, Chuang, et al. "An information hiding scheme for OFDM wireless networks." 2006 International Conference on Intelligent Information Hiding and Multimedia. IEEE, 2006.*
(Continued)

*Primary Examiner* — Jialong He
(74) *Attorney, Agent, or Firm* — William Park & Associates Ltd.

(57) ABSTRACT

Methods and apparatuses for hiding and extracting data based on a pilot code sequence are provided. A data hiding method may include converting an input audio signal to a frequency domain, distorting phase information of the audio signal converted to the frequency domain based on a pilot code sequence representing data to be hidden, and converting the audio signal with the distorted phase information to a time domain and transmitting the audio signal converted to the time domain. The pilot code sequence may be a set of phase values corresponding to a bit value "0" or "1" of data.

10 Claims, 7 Drawing Sheets

(56) References Cited

U.S. PATENT DOCUMENTS

| | | | | |
|---|---|---|---|---|
| 2014/0172141 | A1* | 6/2014 | Mangold | H04B 11/00 700/94 |
| 2016/0104498 | A1* | 4/2016 | Beack | G10L 19/018 704/500 |
| 2016/0203824 | A1* | 7/2016 | Park | G10L 19/018 700/94 |

OTHER PUBLICATIONS

Ansari, Rashid, Hafiz Malik, and Ashfaq Khokhar. "Data-hiding in audio using frequency-selective phase alteration." Acoustics, Speech, and Signal Processing, 2004. Proceedings.(ICASSP'04). IEEE International Conference on. vol. 5. IEEE, 2004.*

Bender, Walter, et al. "Techniques for data hiding." IBM systems journal 35.3.4 (1996): 313-336.*

Swanson, Mitchell D., Mei Kobayashi, and Ahmed H. Tewfik. "Multimedia data-embedding and watermarking technologies." Proceedings of the IEEE 86.6 (1998): 1064-1087.*

Mansour, Mohamed F., and Ahmed H. Tewfik. "Time-scale invariant audio data embedding." EURASIP Journal on Applied Signal Processing 2003 (2003): 993-1000.*

Wu, Jianhua, and Leif Kobbelt. "Efficient spectral watermarking of large meshes with orthogonal basis functions." The Visual Computer 21.8 (2005): 848-857.*

Arnold et al. "A Phase-Based Audio Watermarking System Robust to Acoustic Path Propagation", IEEE Transactions on Information Forensics and Security, vol. 9, No. 3, Mar. 2014.*

Hosei Matsuoka et al., "Acoustic OFDM system and its extension," The Visual Computer, Aug. 15, 2008, pp. 3-12, vol. 25, Issue 1.

* cited by examiner

APPARATUS AND METHOD FOR HIDING AND EXTRACTING DATA USING PILOT CODE SEQUENCE

CROSS-REFERENCE TO RELATED APPLICATION

This application claims the benefit of Korean Patent Application No. 10-2015-0046817, filed on Apr. 2, 2015, in the Korean Intellectual Property Office, the disclosure of which is incorporated herein by reference.

BACKGROUND

1. Field of the Invention

Embodiments relate to an apparatus and method for hiding data in an audio signal and extracting the data from the audio signal, and more particularly, to an apparatus and method for hiding data in an audio signal and extracting the data from the audio signal based on a pilot code sequence.

2. Description of the Related Art

An audio watermark technology includes a technology of carrying required additional information in an audio signal by adding arbitrary distortion or a arbitrary signal and of extracting the additional information. The additional information carried on the audio signal may be used to guarantee a quality of the audio signal at a minimum loss and to discriminate a copyright of the original audio signal.

Recently, due to a wide use of portable smart terminal equipment, the audio watermark technology is showing a possibility to be used as a scheme of transmitting additional information utilized in a portable terminal in addition to copyright discrimination. In addition to existing constraints, additional information may need to be extracted robustly against acoustic channel distortion until the audio signal is spread in the air and received to a microphone. Also, to perform an additional service desired by a user, a high quantity of data associated with transmitted additional information may be required. For example, the additional information may include, for example, channel information, time information or uniform resource locator (URL) information. A portable terminal may extract text information from a received signal only when tens of bytes of text information is transmitted within a set period of time.

However, in most cases, a large number of bit errors may occur in data associated with extracted additional information due to reverberation or noise occurring in an acoustic channel, in comparison to the original data.

SUMMARY

Embodiments provide a method and apparatus for hiding data associated with additional information in an audio signal based on a pilot code sequence, and extracting the data from the audio signal based on the pilot code sequence so that the data may be robust against distortion in an acoustic channel.

According to an aspect, there is provided a data hiding method including converting an input audio signal to a frequency domain, distorting phase information of the audio signal converted to the frequency domain based on a pilot code sequence representing data to be hidden, and converting the audio signal with the distorted phase information to a time domain and transmitting the audio signal converted to the time domain, wherein the pilot code sequence is a set of phase values corresponding to a bit value "0" or "1" of data.

The converting of the input audio signal to the frequency domain may include dividing the input audio signal into frames and converting each of the frames to the frequency domain.

A pilot code sequence representing the bit value "0" and a pilot code sequence representing the bit value "1" may be orthogonal to each other.

An inner product of the pilot code sequence representing the bit value "0" and the pilot code sequence representing the bit value "1" may be zero.

According to another aspect, there is provided a data extracting method including receiving an audio signal with distorted phase information, converting the received audio signal to a frequency domain, determining a phase sequence of the audio signal converted to the frequency domain, and extracting data hidden in the audio signal based on a pilot code sequence and the determined phase sequence, wherein the pilot code sequence is a set of phase values corresponding to a bit value "0" or "1" of data.

The converting of the received audio signal may include dividing the received audio signal into frames and converting each of the frames to the frequency domain.

The determining of the phase sequence may include mapping the distorted phase information to a value of an angle close to either 0 radians or $\pi$ radians.

The determining of the phase sequence may include mapping a phase value between −90 degrees and +90 degrees in the distorted phase information to 0 radians, and mapping the other phase values to $\pi$ radians.

The extracting of the data may include changing phase values of each of the pilot code sequence and the phase sequence to real numbers.

The extracting of the data may include extracting the data hidden in the audio signal based on a similarity between the changed phase values.

According to another aspect, there is provided a data hiding apparatus including a converter configured to convert an input audio signal to a frequency domain, a distorter configured to distort phase information of the audio signal converted to the frequency domain based on a pilot code sequence representing data to be hidden, and a transmitter configured to convert the audio signal with the distorted phase information to a time domain and to transmit the audio signal converted to the time domain, wherein the pilot code sequence is a set of phase values corresponding to a bit value "0" or "1" of data.

The converter may be configured to divide the input audio signal into frames and convert each of the frames to the frequency domain.

A pilot code sequence representing the bit value "0" and a pilot code sequence representing the bit value "1" may be orthogonal to each other.

An inner product of the pilot code sequence representing the bit value "0" and the pilot code sequence representing the bit value "1" may be zero.

According to another aspect, there is provided a data extracting apparatus including a receiver configured to receive an audio signal with distorted phase information, a converter configured to convert the received audio signal to a frequency domain, a determiner configured to determine a phase sequence of the audio signal converted to the frequency domain, and an extractor configured to extract data hidden in the audio signal based on a pilot code sequence and the determined phase sequence, wherein the pilot code sequence is a set of phase values corresponding to a bit value "0" or "1" of data.

The converter may be configured to divide the received audio signal into frames and convert each of the frames to the frequency domain.

The determiner may be configured to map the distorted phase information to a value of an angle close to either 0 radians or π radians.

The determiner may be configured to map a phase value between −90 degrees and +90 degrees in the distorted phase information to 0 radians, and to map the other phase values to π radians.

The extractor may be configured to change phase values of each of the pilot code sequence and the phase sequence to real numbers.

The extractor may be configured to extract the data hidden in the audio signal based on a similarity between the changed phase values.

Effect

According to embodiments, a pilot code sequence may be used to hide data associated with additional information in an audio signal and to extract the data from the audio signal, and thus it is possible to hide and extract the data so that the data may be robust against distortion in an acoustic channel.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
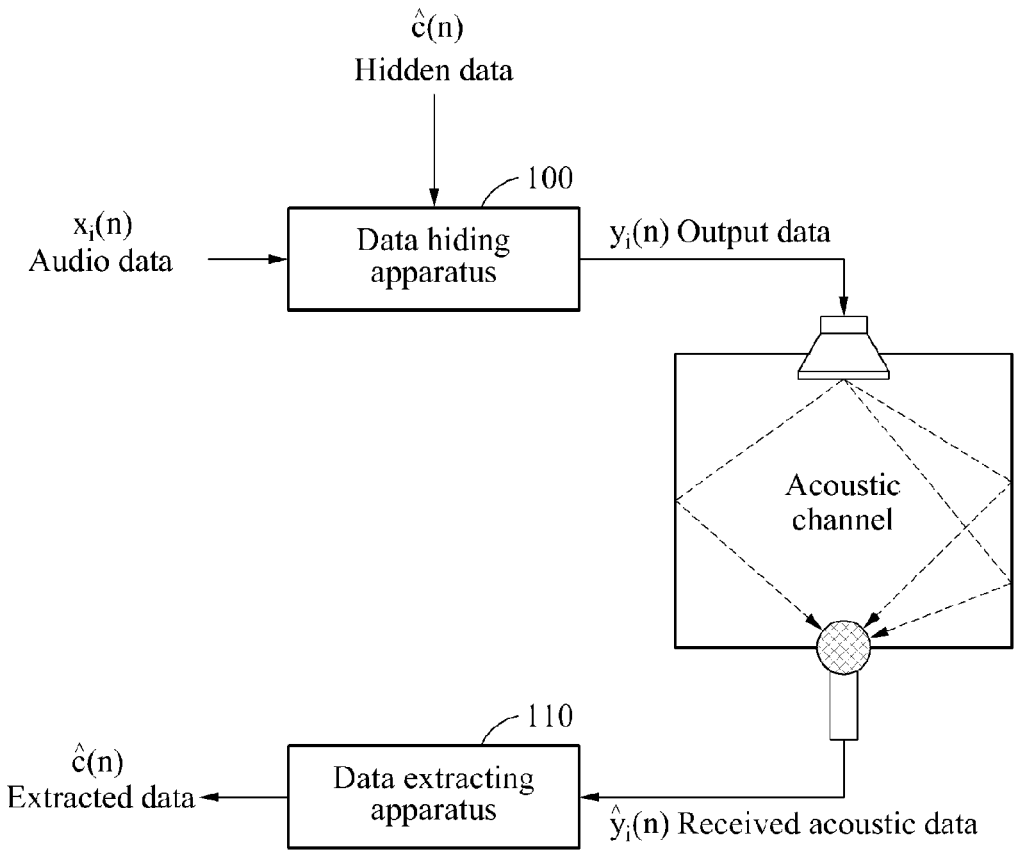
FIG. 1 illustrates a data transmission method based on a data hiding and extracting method according to an embodiment.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 illustrates a data transmission method based on a data hiding and extracting method according to an embodiment.

A data hiding apparatus 100 of FIG. 1 may hide desired data in an audio signal based on a pilot code sequence. The data hiding apparatus 100 may convert the audio signal to a frequency domain. The data hiding apparatus 100 may divide the audio signal into frames and may convert the frames, and the audio signal converted to the frequency domain may include magnitude information and phase information. A single frame of a signal may be generally represented as shown in Equation 1 below.

$$x(b)=[x(n-N+1), \ldots, x(n)]^T \quad \text{[Equation 1]}$$

In Equation 1, b denotes an index of a frame in an audio signal, and N denotes a number of frequency bins modulated in the frame.

To convert an audio signal to a frequency domain, an amplitude-shift keying (ASK) scheme, a frequency-shift keying (FSK) scheme, or a phase-shift keying (PSK) scheme may be used. According to embodiments, the PSK scheme may be used to convert an audio signal to a frequency domain. For example, an audio signal may be converted to a frequency domain using the PSK scheme as shown in Equation 2 below.

$$X(b)=\mathrm{DFT}(x(b))=[X_b(0), \ldots, X((N)/2)]^T \quad \text{[Equation 2]}$$

An audio signal X(b) may be a mixture of signals having different frequencies, and may have N frequency conversion coefficients. Because the N frequency conversion coefficients are symmetrical to each other, "N/2+1" pieces of information may be valid.

The data hiding apparatus 100 may hide desired data in an arbitrary frame of the audio signal converted to the frequency domain. For example, the data hiding apparatus 100 may hide the data in a frame b among frames of the audio signal using the PSK scheme.

$$X_{sub}(b)=[X_b(k-M+1), \ldots, X(k)]^T,\ 0 \le M \le N/2,\ M-1 \le k \le N/2 \quad \text{[Equation 3]}$$

In Equation 3, b denotes an index of a frame in an audio signal, and M denotes a number of frequency bins modulated in the frame. In addition, k denotes an index of a frequency bin. In other words, the data hiding apparatus 100 may distort information on the number M of frequency bins in the frame b, and may transmit the data.

For example, when M and k are set to "4" and "3," respectively, a result of conversion of the audio signal to the frequency domain may be represented based on magnitude information and phase information of the audio signal as shown in Equation 4 below.

$$X_{sub}(b)=[X_b(0), X_b(1), X_b(2), X_b(3)]^T=[|X_b(0)|\angle X_b(0), |X_b(1)|\angle X_b(1), |X_b(2)|\angle X_b(2), |X_b(3)|\angle X_b(3)]^T \quad \text{[Equation 4]}$$

The data hiding apparatus 100 may distort the phase information while maintaining the magnitude information and may hide the data in the audio signal converted to the frequency domain, which may be represented as shown in Equation 5 below.

$$\hat{X}_{sub}(b)=[|X_b(0)|\angle\theta_0, |X_b(1)|\angle\theta_1, |X_b(2)|\angle\theta_2, |X_b(3)|\angle\theta_3]^T \quad \text{[Equation 5]}$$

In Equation 5, data $c(b)=[\theta_0,\theta_1,\theta_2,\theta_3]^T$ to be hidden may be represented by four bits, and may be hidden by distorting phase information of an audio signal. For example, when data [1,0,1,1] is assumed to be transmitted using a binary PSK (BPSK) scheme, the data [1,0,1,1] may be represented as $c(b)=[\pi,0\pi,\pi]^T$, and may be transmitted by distorting phase information of an audio signal.

However, when a general PSK scheme is used to hide data as described above, a bit error ratio (BER) may increase as a quantity of data to be hidden increases. Thus, according to embodiments, desired data may be hidden in an audio signal based on a pilot code sequence so that the data may be more robust against acoustic channel distortion.

The pilot code sequence may be, for example, a set of phase values corresponding to a bit value "0" or a set of phase values corresponding to a bit value "1." The data hiding apparatus 100 may distort phase information of an audio signal based on the set of the phase values corresponding to the bit value "0" or the set of the phase values corresponding to the bit value "1," and may hide desired data in the audio signal.

A pilot code sequence including the phase values corresponding to the bit value "0" and a pilot code sequence including the phase values corresponding to the bit value "1" may be orthogonal to each other. In other words, an inner product of the pilot code sequence including the phase values corresponding to the bit value "0" and the pilot code sequence including the phase values corresponding to the bit value "1" may need to be zero, which may be represented as shown in Equation 6 below.

$$\langle c_0, c_1 \rangle = \sum_{i=0}^{M-1} \angle c_0(i) \angle c_1(i) = 0 \quad \text{[Equation 6]}$$

In Equation 6, the pilot code sequence including the phase values corresponding to the bit value "0" and the pilot code sequence including the phase values corresponding to the bit value "1" may be represented as $c_0=[\angle c_0(0), \ldots, \angle c_0(i), \ldots, \angle c_0(M-1)]^T$ and $c_1=[\angle c_1(0), \ldots, \angle c_1(i), \ldots, \angle c_1(M-1)]^T$ respectively.

In other words, values obtained by multiplying phase values for each frequency bin in the pilot code sequence representing the bit value "0" and the pilot code sequence representing the bit value "1" may need to be added up to zero.

For example, a pilot code sequence $c_0$ representing the bit value "0" and a pilot code sequence $c_1$ representing the bit value "1" may be $[\angle\pi, \angle 0, \angle\pi, \angle 0, \ldots]^T$ and $[\angle\pi, \angle\pi, \angle 0, \angle 0, \ldots]^T$, respectively. In this example, an inner product of the pilot code sequences $c_0$ and $c_1$ may be zero.

The data hiding apparatus 100 may distort phase information of an audio signal based on phase values included in a pilot code sequence, to hide desired data in the audio signal.

For example, a single bit may be assumed to be inserted into a frame of a real audio signal, and k and M may be set to "3" and "4," respectively. In this example, a process of hiding data [0,1,1,0] in the audio signal may be represented as shown in Equation 7 below.

$$\hat{X}_{sub}(0)=[|X_0(0)|\angle 0, |X_0(1)|\angle\pi, |X_0(2)|\angle 0, |X_0(3)|\angle\pi]^T$$

$$\hat{X}_{sub}(1)=[|X_1(0)|\angle 0, |X_1(1)|\angle 0, |X_1(2)|\angle\pi, |X_1(3)|\angle\pi]^T$$

$$\hat{X}_{sub}(2)=[|X_2(0)|\angle 0, |X_2(1)|\angle 0, |X_2(2)|\angle\pi, |X_2(3)|\angle\pi]^T$$

$$\hat{X}_{sub}(3)=[|X_3(0)|\angle 0, |X_3(1)|\angle\pi, |X_3(2)|\angle 0, |X_3(3)|\angle\pi]^T \quad \text{[Equation 7]}$$

The data hiding apparatus 100 may convert the audio signal to a frequency domain. Equation 7 shows an example of converting an audio signal including four frames, for example, a zeroth frame through a third frame to a frequency domain, and of distorting phase information of the audio signal based on pilot code sequences for each of the frames. Phase information corresponding to the zeroth frame may be distorted based on a pilot code sequence representing a bit value "0." Also, phase information corresponding to a first frame may be distorted based on a pilot code sequence representing a bit value "1." Similarly, phase information corresponding to a second frame and phase information corresponding to the third frame may be distorted based on a pilot code sequence representing a bit value "1" and a pilot code sequence representing a bit value "0," respectively.

The data hiding apparatus 100 may convert the audio signal with the distorted phase information from the frequency domain to a time domain using the PSK scheme. The audio signal converted to the time domain may be output through an acoustic channel using an output device, for example, speakers. When the audio signal output through the acoustic channel is received by a receiver, for example, a microphone, a larger number of bit errors may occur in the received audio signal due to reverberation or noise, in comparison to the output audio signal.

A data extracting apparatus 110 may receive the audio signal affected by the reverberation or noise, and may extract the hidden data. The data extracting apparatus 110 may convert the received audio signal to the frequency domain. The data extracting apparatus 110 may divide the received audio signal into frames, and may convert each of the frames to the frequency domain. The audio signal converted to the frequency domain may include magnitude information and phase information, which may be represented as shown in Equation 8 below.

$$\hat{Y}_{sub}(0)=[|Y_0(0)|\angle Y_0(0), |Y_0(1)|\angle Y_0(1), |Y_0(2)|\angle Y_0(2), |Y_0(3)|\angle Y_0(3)]^T$$

$$\hat{Y}_{sub}(1)=[|Y_1(0)|\angle Y_1(0), |Y_1(1)|\angle Y_1(1), |Y_1(2)|\angle Y_1(2), |Y_1(3)|\angle Y_1(3)]^T$$

$$\hat{Y}_{sub}(2)=[|Y_2(0)|\angle Y_2(0), |Y_2(1)|\angle Y_2(1), |Y_2(2)|\angle Y_2(2), |Y_2(3)|\angle Y_2(3)]^T$$

$$\hat{Y}_{sub}(3)=[|Y_3(0)|\angle Y_3(0), |Y_3(1)|\angle Y_3(1), |Y_3(2)|\angle Y_3(2), |Y_3(3)|\angle Y_3(3)]^T$$

In Equation 8, an absolute value of each of frequency bins may be "1," and phase values may be represented as shown in Equation 9 below.

$$\hat{Y}_{sub}(0)=[\angle Y_0(0), \angle Y_0(1), \angle Y_0(2), \angle Y_0(3)]^T$$

$$\hat{Y}_{sub}(1)=[\angle Y_1(0), \angle Y_1(1), \angle Y_1(2), \angle Y_1(3)]^T$$

$$\hat{Y}_{sub}(2)=[\angle Y_2(0), \angle Y_2(1), \angle Y_2(2), \angle Y_2(3)]^T$$

$$\hat{Y}_{sub}(3)=[\angle Y_3(0), \angle Y_3(1), \angle Y_3(2), \angle Y_3(3)]^T \quad \text{[Equation 9]}$$

Phase information of each of the frames in the audio signal converted to the frequency domain by the data extracting apparatus 110 may be affected by reverberation or noise in an acoustic channel, and accordingly may be different from phase information of a pilot code sequence distorted by the data hiding apparatus 100.

The data extracting apparatus 110 may need to map the phase information of each of the frames in the audio signal converted to the frequency domain to a value of an angle close to either 0 radians or π radians. For example, a phase value between −90 degrees and +90 degrees may be mapped to 0 radians, and the other phase values may be mapped to π radians.

The data extracting apparatus 110 may extract the data hidden in the audio signal by comparing the mapped phase information to the phase information of the pilot code sequence. To this end, the data extracting apparatus 110 may express the mapped phase information as a real number. For example, the data extracting apparatus 110 may express a phase value of 0 radians and a phase value of π radians in the mapped phase information as "1" and "−1," respectively, which may be represented as shown in Equation 10 below.

$$\hat{Y}_{sub}(0)=[1,-1,1,-1]^T$$

$$\hat{Y}_{sub}(1)=[-1,-1,1,1]^T$$

$$\hat{Y}_{sub}(2)=[-1,-1,1,1]^T$$

$$\hat{Y}_{sub}(3)=[1,-1,1,-1]^T \quad \text{[Equation 10]}$$

To compare the phase information expressed as the real number to the phase information of the pilot code sequence, the data extracting apparatus 110 may also express the phase information of the pilot code sequence as a real number. For example, pilot code sequences may be expressed as $c_0[1,-1,1,-1]$ and $[-1,-1,1,1]^T$.

The data extracting apparatus 110 may measure a correlation between the real number representing the mapped phase information and the real number representing the phase information of the pilot code sequence, and may extract the data hidden in the audio signal. To measure the correlation, various schemes may be used, and for example, a circular convolution may be used in accordance with embodiments as shown in Equation 11 below.

$$c(b) = \arg_i\{\text{count}(\max(\hat{Y}_{sub}(b) \otimes c_i))\} \quad \text{[Equation 11]}$$

The data extracting apparatus 110 may perform circular convolution between $\hat{Y}_{sub}(b)$ and $c_i$ in which i has a value of "0" and "1," as shown in Equation 11. As a result of the circular convolution, a plurality of identical maximum values may be generated, and may be acquired using a max operator. The data extracting apparatus 110 may measure a number of times the maximum values are acquired, using a count operator. A value of $c_i$ having a maximum number of times maximum values are acquired for each sequence may be assigned to the data hidden in the audio signal.

Figure 2:
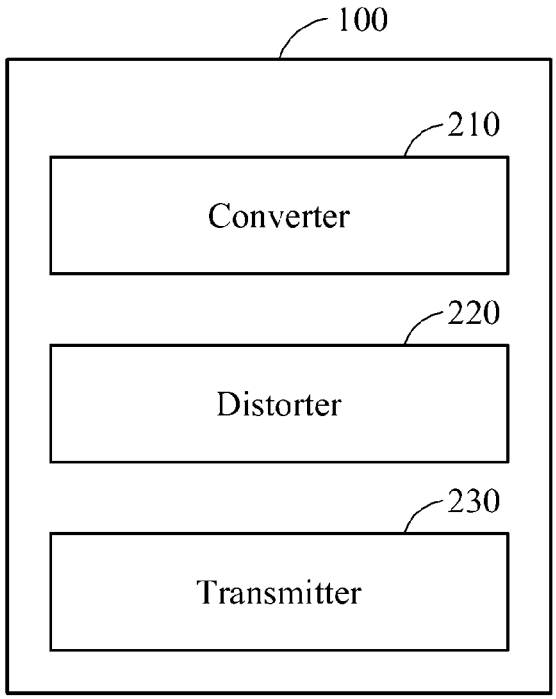
FIG. 2 illustrates a configuration of a data hiding apparatus of FIG. 1.

FIG. 2 illustrates a configuration of the data hiding apparatus 100 of FIG. 1.

Referring to FIG. 2, the data hiding apparatus 100 may include a converter 210, a distorted 220 and a transmitter 230. The converter 210 may convert an audio signal to a frequency domain. The data hiding apparatus 100 may divide the audio signal into frames and may convert the frames, and the audio signal converted to the frequency domain may include magnitude information and phase information. To convert the audio signal to the frequency domain, an ASK scheme, an FSK scheme or a PSK scheme may be used. According to embodiments, the PSK scheme may be used to convert an audio signal to a frequency domain.

The distorter 220 may hide desired data in the audio signal converted to the frequency domain. For example, the distorter 220 may distort the phase information while maintaining the magnitude information and may hide the data in the audio signal converted to the frequency domain. In this example, the distorter 220 may hide the data in the audio signal based on a pilot code sequence so that the data may be more robust against acoustic channel distortion.

The pilot code sequence may be, for example, a set of phase values corresponding to a bit value "0" or a set of phase values corresponding to a bit value "1." The distorter 220 may distort phase information of an audio signal based on the set of the phase values corresponding to the bit value "0" or the set of the phase values corresponding to the bit value "1," and may hide desired data in the audio signal.

A pilot code sequence including the phase values corresponding to the bit value "0" and a pilot code sequence including the phase values corresponding to the bit value "1" may be orthogonal to each other. An inner product of the pilot code sequence including the phase values corresponding to the bit value "0" and the pilot code sequence including the phase values corresponding to the bit value "1" may need to be zero. In other words, values obtained by multiplying phase values for each frequency bin in the pilot code sequence representing the bit value "0" and the pilot code sequence representing the bit value "1" may need to be added up to zero.

The distorter 220 may distort the phase information of the audio signal based on phase values included in a pilot code sequence, to hide desired data in the audio signal.

The transmitter 230 may transmit the audio signal in which the data is hidden by distorting the phase information to an output device, for example, speakers. The transmitted audio signal may be output through an acoustic channel.

Figure 3A:
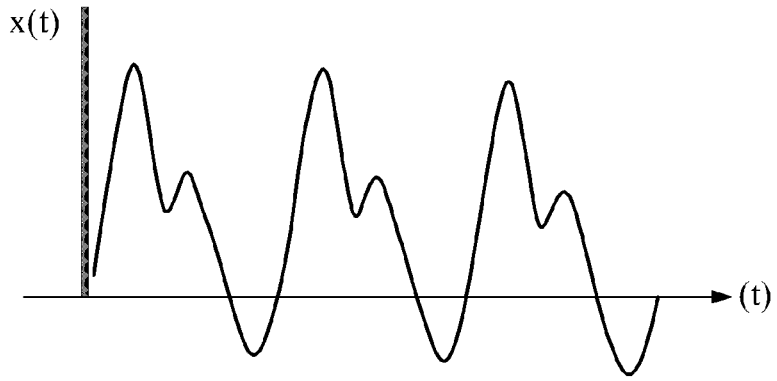
FIGS. 3A and 3B illustrate an example of converting an audio signal to a frequency domain according to an embodiment.
Figure 3B:
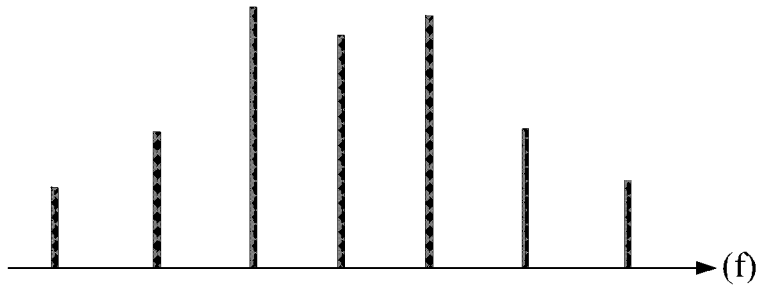

FIGS. 3A and 3B are graphs provided to explain an example of converting an audio signal to a frequency domain according to an embodiment.

To convert the audio signal to the frequency domain, an ASK scheme, an FSK scheme or a PSK scheme may be used. According to embodiments, the PSK scheme may be used to convert an audio signal to a frequency domain.

An audio signal shown in the graph of FIG. 3A may be a mixture of signals having different frequencies. The audio signal may be, for example, a signal generated by combining sine waves having various amplitudes and periods. The audio signal of FIG. 3A may be converted to a frequency domain as shown in FIG. 3B. In other words, the audio signal of FIG. 3A changing over time may be a sum of signals having various frequencies.

The data hiding apparatus 100 may distort a frequency of the audio signal based on phase information of a pilot code sequence as shown in FIG. 3B, and may hide data. Accordingly, the hidden data may be more robust against acoustic channel distortion.

Figure 4:
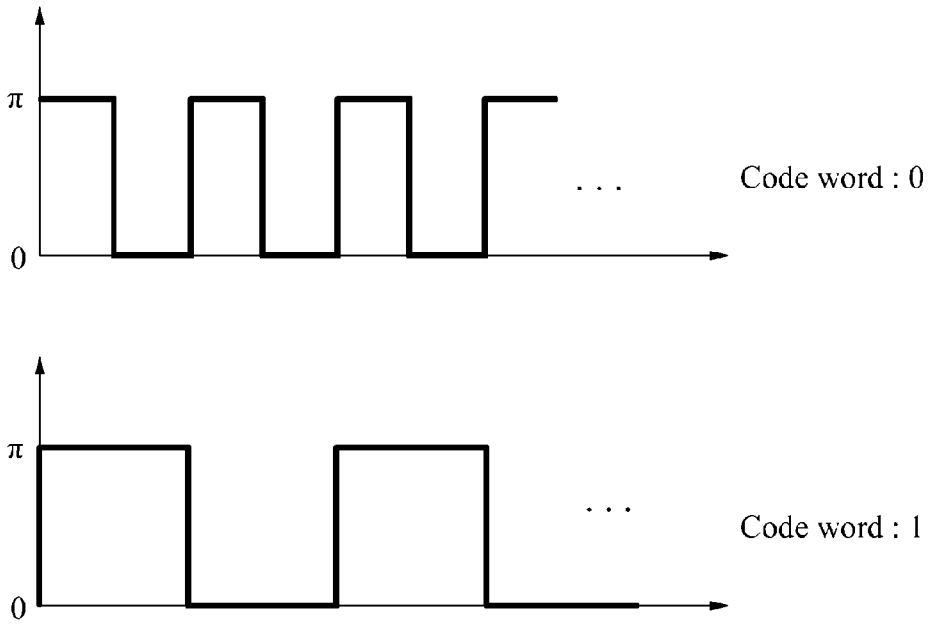
FIG. 4 illustrates an example of a pilot code sequence according to an embodiment.

FIG. 4 illustrates an example of a pilot code sequence according to an embodiment.

The data hiding apparatus 100 may hide desired data in an audio signal based on a pilot code sequence. The pilot code sequence may be, for example, a set of phase values corresponding to a bit value "0" or a set of phase values corresponding to a bit value "1." The data hiding apparatus 100 may distort phase information of the audio signal based on the set of the phase values corresponding to the bit value "0" or the set of the phase values corresponding to the bit value "1," and may hide the desired data in the audio signal.

A pilot code sequence including the phase values corresponding to the bit value "0" and a pilot code sequence including the phase values corresponding to the bit value "1" may be orthogonal to each other. An inner product of the pilot code sequence including the phase values corresponding to the bit value "0" and the pilot code sequence including the phase values corresponding to the bit value "1" may need to be zero. In other words, values obtained by multiplying phase values for each frequency bin in the pilot code sequence representing the bit value "0" and the pilot code sequence representing the bit value "1" may need to be added up to zero.

For example, phase information of the pilot code sequence representing the bit value "0" may have a value of $[\angle\pi,\angle 0,\angle\pi,\angle 0, \ldots]^T$, and phase information of the pilot code sequence representing the bit value "1" may have a value of $[\angle\pi,\angle\pi,\angle 0,\angle 0, \ldots]^T$. In this example, an inner product of the pilot code sequences may be zero.

Figure 5:
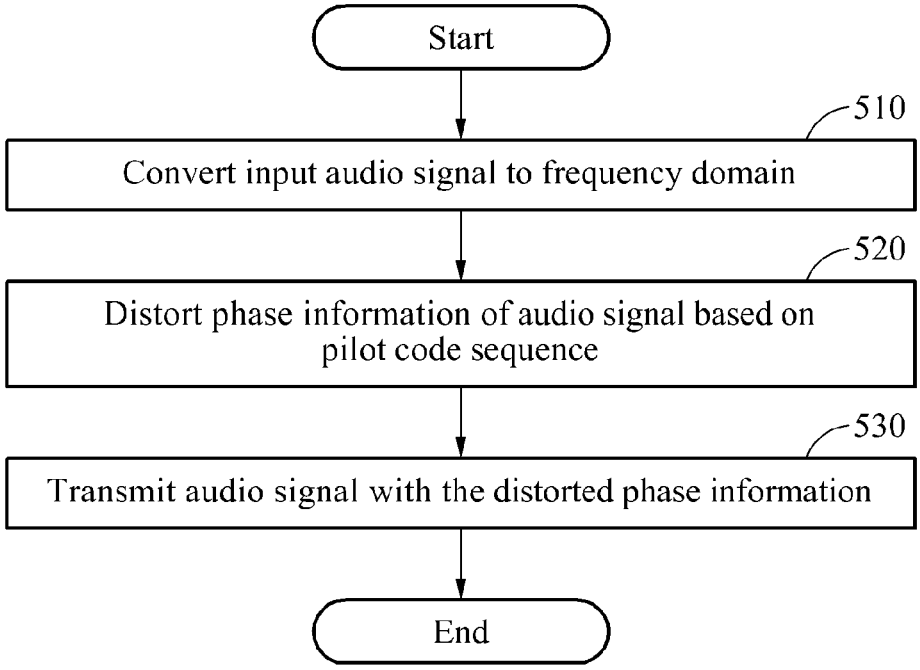
FIG. 5 illustrates a method of hiding data based on a pilot code sequence according to an embodiment.

FIG. 5 illustrates a method of hiding data based on a pilot code sequence according to an embodiment.

Referring to FIG. 5, in operation 510, the data hiding apparatus 100 may convert an input audio signal to a frequency domain. The data hiding apparatus 100 may divide the audio signal into frames and may convert the frames, and the audio signal converted to the frequency domain may include magnitude information and phase information.

To convert the audio signal to the frequency domain, an ASK scheme, an FSK scheme or a PSK scheme may be used. According to embodiments, the PSK scheme may be used to convert an audio signal to a frequency domain.

In operation 520, the data hiding apparatus 100 may distort the phase information of the audio signal based on a pilot code sequence, to hide data. The pilot code sequence may be, for example, a set of phase values corresponding to a bit value "0" or a set of phase values corresponding to a bit value "1." The data hiding apparatus 100 may distort the phase information of the audio signal based on the set of the phase values corresponding to the bit value "0" or the set of the phase values corresponding to the bit value "1," and may hide desired data in the audio signal.

A pilot code sequence including the phase values corresponding to the bit value "0" and a pilot code sequence including the phase values corresponding to the bit value "1" may be orthogonal to each other. An inner product of the pilot code sequence including the phase values corresponding to the bit value "0" and the pilot code sequence including the phase values corresponding to the bit value "1" may need to be zero. In other words, values obtained by multiplying phase values for each frequency bin in the pilot code sequence representing the bit value "0" and the pilot code sequence representing the bit value "1" may need to be added up to zero.

In operation 530, the data hiding apparatus 100 may transmit the audio signal with the distorted phase information. The transmitted audio signal may be output through an acoustic channel using an output device, for example, speakers.

Figure 6:
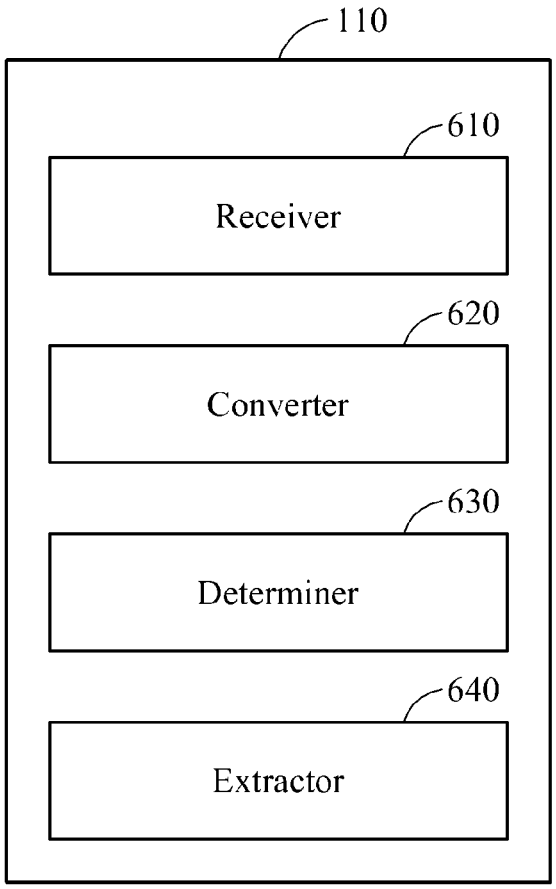
FIG. 6 illustrates a configuration of a data extracting apparatus of FIG. 1.

FIG. 6 illustrates a configuration of the data extracting apparatus 110 of FIG. 1.

Referring to FIG. 6, the data extracting apparatus 110 may include a receiver 610, a converter 620, a determiner 630 and an extractor 640. The receiver 610 may receive an audio signal with distorted phase information. A larger number of bit errors may occur in the received audio signal due to reverberation or noise, in comparison to the original audio signal.

The converter 620 may convert the received audio signal to a frequency domain. The data extracting apparatus 110 may divide the received audio signal into frames and may convert the frames, and the audio signal converted to the frequency domain may include magnitude information and phase information.

To convert the audio signal to the frequency domain, an ASK scheme, an FSK scheme or a PSK scheme may be used. According to embodiments, the PSK scheme may be used to convert an audio signal to a frequency domain.

The determiner 630 may map phase information of each of the frames in the received audio signal to a value of an angle close to either 0 radians or $\pi$ radians. The phase information of the audio signal distorted by the data hiding apparatus 100 may be affected by reverberation or noise in an acoustic channel. Accordingly, the determiner 630 may need to determine the phase information of each of the frames in the received audio signal as 0 radians and $\pi$ radians that are phase information of a pilot code sequence. For example, the determiner 630 may map a phase value between −90 degrees and +90 degrees to 0 radians, and may map the other phase values to $\pi$ radians.

The extractor 640 may extract data hidden in the received audio signal. The extractor 640 may compare the mapped phase information to the phase information of the pilot code sequence, and may extract the data hidden in the received audio signal. To this end, the extractor 640 may express the mapped phase information and the phase information of the pilot code sequence as real numbers. For example, the extractor 640 may express a phase value of 0 radians and a phase value of $\pi$ radians in the mapped phase information as "1" and "−1," respectively. Similarly, the extractor 640 may express a phase value of 0 radians and a phase value of $\pi$ radians in the phase information of the pilot code sequence as "1" and "−1," respectively.

The extractor 640 may measure a correlation between the real number representing the mapped phase information and the real number representing the phase information of the pilot code sequence, and may extract the data hidden in the received audio signal. Various schemes may be used to measure the correlation, and for example, a circular convolution may be used to measure the correlation in accordance with embodiments. Because a similarity is measured by performing the circular convolution during measuring of the correlation, a repetitive sequence may have a plurality of maximum values. A number of times the maximum values are acquired may be measured, and an index value of a pilot code sequence having a maximum number of times the maximum values are acquired for each sequence may be assigned to the data hidden in the audio signal.

Figure 7:
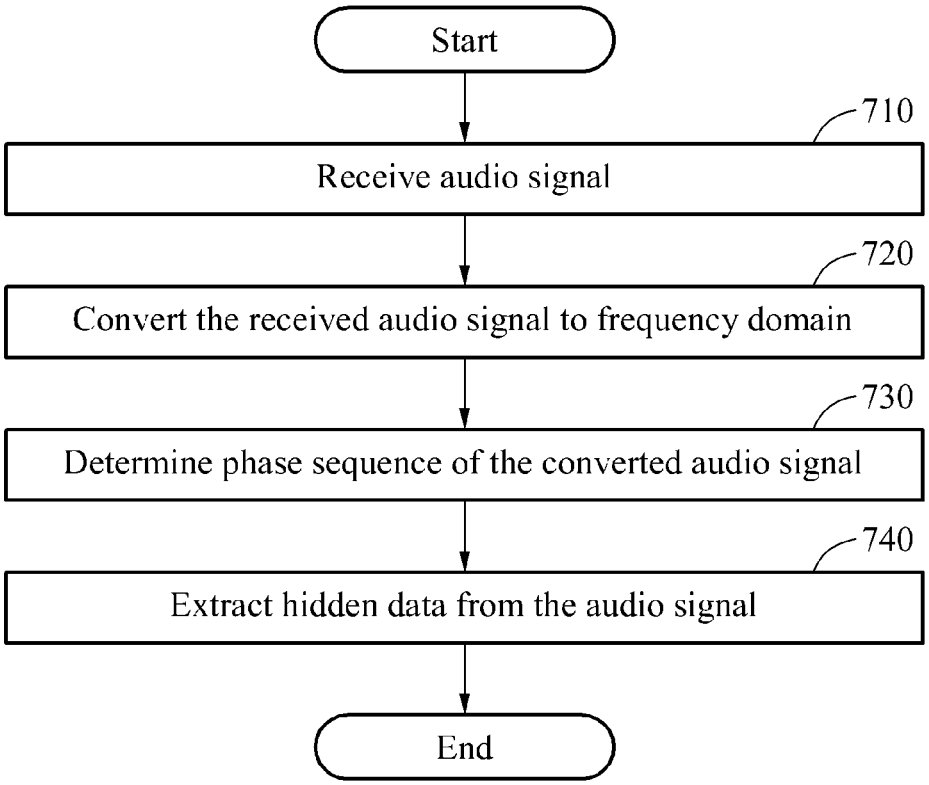
FIG. 7 illustrates a method of extracting data based on a pilot code sequence according to an embodiment.

FIG. 7 illustrates a method of extracting data based on a pilot code sequence according to an embodiment.

Referring to FIG. 7, in operation 710, the data extracting apparatus 110 may receive an audio signal with distorted phase information. A larger number of bit errors may occur in the received audio signal due to reverberation or noise, in comparison to the original audio signal.

In operation 720, the data extracting apparatus 110 may convert the received audio signal to a frequency domain. The data extracting apparatus 110 may divide the received audio signal into frames and may convert the frames, and the audio signal converted to the frequency domain may include magnitude information and phase information.

To convert the audio signal to the frequency domain, an ASK scheme, an FSK scheme or a PSK scheme may be used. According to embodiments, the PSK scheme may be used to convert an audio signal to a frequency domain.

In operation 730, the data extracting apparatus 110 may map phase information of each of the frames in the received audio signal to a value of an angle close to either 0 radians or $\pi$ radians. The phase information of the audio signal distorted by the data hiding apparatus 100 may be affected by reverberation or noise in an acoustic channel. Accordingly, the data extracting apparatus 110 may need to determine the phase information of each of the frames in the received audio signal as 0 radians and $\pi$ radians that are phase information of a pilot code sequence. For example, the data extracting apparatus 110 may map a phase value between −90 degrees and +90 degrees to 0 radians, and may map the other phase values to $\pi$ radians.

In operation 740, the data extracting apparatus 110 may extract data hidden in the received audio signal. The data extracting apparatus 110 may compare the mapped phase information to the phase information of the pilot code sequence, and may extract the data hidden in the received audio signal. To this end, the data extracting apparatus 110 may express the mapped phase information and the phase information of the pilot code sequence as real numbers. For example, the data extracting apparatus 110 may express a phase value of 0 radians and a phase value of π radians in the mapped phase information as "1" and "−1," respectively. Similarly, the data extracting apparatus 110 may express a phase value of 0 radians and a phase value of π radians in the phase information of the pilot code sequence as "1" and "−1," respectively.

The data extracting apparatus 110 may measure a correlation between the real number representing the mapped phase information and the real number representing the phase information of the pilot code sequence, and may extract the data hidden in the received audio signal. Various schemes may be used to measure the correlation, and for example, a circular convolution may be used to measure the correlation in accordance with embodiments. Because a similarity is measured by performing the circular convolution during measuring of the correlation, a repetitive sequence may have a plurality of maximum values. A number of times the maximum values are acquired may be measured, and an index value of a pilot code sequence having a maximum number of times the maximum values are acquired for each sequence may be assigned to the data hidden in the audio signal.

The units described herein may be implemented using hardware components, software components, or a combination thereof. For example, the hardware components may include microphones, amplifiers, band-pass filters, audio to digital convertors, and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The method according to the above-described embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the embodiments, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Although a few embodiments have been shown and described, the present invention is not limited to the described embodiments. Instead, it would be appreciated by those skilled in the art that changes may be made to these exemplary embodiments without departing from the principles and spirit of the invention, the scope of which is defined by the claims and their equivalents.

What is claimed is:

1. A data hiding method, the method comprising:

converting an input audio signal to a frequency domain using at least one processor;

distorting phase information of the audio signal converted to the frequency domain based on a first pilot code sequence and a second pilot code sequence using the at least one processor, each of the first pilot code sequence and the second pilot code sequence representing data to be hidden;

converting the audio signal with the distorted phase information to a time domain using the at least one processor; and transmitting the audio signal converted to the time domain to a channel through at least one speaker, wherein the first pilot code sequence is generated with a first set of phase values corresponding to a bit value "0" of the data, wherein the second pilot code sequence is generated with a second set of phase values corresponding to a bit value "1" of the data, and wherein an inner product of the first pilot code sequence and the second pilot code sequence is zero.

2. The data hiding method of claim 1, wherein the converting of the input audio signal to the frequency domain comprises dividing the input audio signal into frames and converting each of the frames to the frequency domain.

3. A data extracting method comprising:

receiving an audio signal with distorted phase information using at least one microphone;

converting the received audio signal to a frequency domain using at least one processor;

determining a phase sequence of the audio signal converted to the frequency domain using the at least one processor; and extracting data hidden in the audio signal based on a first pilot code sequence, a second pilot code sequence, and the determined phase sequence, wherein the first pilot code sequence is generated with a first set of phase values corresponding to a bit value "0" of the data, wherein the second pilot code sequence is generated with a second set of phase values corresponding to a bit value "1" of the data, and wherein an inner product of the first pilot code sequence and the second pilot code sequence is zero.

4. The data extracting method of claim 3, wherein the converting of the received audio signal comprises dividing the received audio signal into frames and converting each of the frames to the frequency domain.

5. The data extracting method of claim 3, wherein the determining of the phase sequence comprises mapping the distorted phase information to a value of an angle close to either 0 radians or $\pi$ radians.

6. The data extracting method of claim 5, wherein the determining of the phase sequence comprises mapping a phase value between −90 degrees and +90 degrees in the distorted phase information to 0 radians, and mapping the other phase values except between −90 degrees and +90 degrees in the distorted phase information to $\pi$ radians.

7. The data extracting method of claim 3, wherein the extracting of the data comprises changing phase values of each of the first pilot code sequence, the second pilot code sequence, and the determined phase sequence to real numbers.

8. The data extracting method of claim 7, wherein the extracting of the data comprises extracting the data hidden in the audio signal based on a similarity between the changed phase values.

9. A data hiding apparatus comprising:

at least one processor processing computer executable program code embodied in a computer accessible medium, the computer executable program code comprising:

a program code for converting an input audio signal to a frequency domain;

a program code for distorting phase information of the audio signal converted to the frequency domain based on a first pilot code sequence and a second pilot code sequence, each of the first pilot code sequence and the second pilot code sequence representing data to be hidden; and a program code for converting the audio signal with the distorted phase information to a time domain; and at least one speaker transmitting the audio signal converted to the time domain, wherein the first pilot code sequence is generated with a first set of phase values corresponding to a bit value "0" of the data, wherein the second pilot code sequence is generated with a second set of phase values corresponding to a bit value "1" of the data, and wherein an inner product of the first pilot code sequence and the second pilot code sequence is zero.

10. The data hiding apparatus of claim 9, wherein the program code for converting the input audio signal to the frequency domain comprises a program code for dividing the input audio signal into frames and convert each of the frames to the frequency domain.

* * * * *